US009605383B2

(12) United States Patent
Jogikalmath et al.

(10) Patent No.: US 9,605,383 B2
(45) **Date of Patent: *Mar. 28, 2017**

(54) HIGH STRENGTH PAPER

(71) Applicant: NANOPAPER, LLC, Cambridge, MA (US)

(72) Inventors: Gangadhar Jogikalmath, Cambridge, MA (US); Patrick D. Kincaid, Hanover, MA (US); Lynn D. Bell, Arlington, MA (US); David S. Soane, Chestnut Hill, MA (US)

(73) Assignee: NANOPAPER, LLC, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/614,999

(22) Filed: Feb. 5, 2015

(65) Prior Publication Data

US 2015/0299958 A1 Oct. 22, 2015

Related U.S. Application Data

(60) Division of application No. 13/331,861, filed on Dec. 20, 2011, now Pat. No. 8,980,059, which is a continuation of application No. PCT/US2010/045162, filed on Aug. 11, 2010.

(60) Provisional application No. 61/233,448, filed on Aug. 12, 2009.

(51) Int. Cl.

| | |
|---|---|
| ***D21H 17/45*** | (2006.01) |
| ***D21H 17/29*** | (2006.01) |
| ***D21H 17/37*** | (2006.01) |
| ***D21H 21/18*** | (2006.01) |
| *D21H 17/41* | (2006.01) |
| *D21H 17/42* | (2006.01) |
| *D21H 17/44* | (2006.01) |
| *D21H 17/56* | (2006.01) |

(52) U.S. Cl.

CPC ..... *D21H 17/455* (2013.01); *D21H 17/29* (2013.01); *D21H 17/375* (2013.01); *D21H 21/18* (2013.01); *D21H 17/41* (2013.01); *D21H 17/42* (2013.01); *D21H 17/44* (2013.01); *D21H 17/56* (2013.01)

(58) Field of Classification Search

CPC ..... D21H 17/29; D21H 17/28; D21H 17/42; D21H 21/10; D21H 21/18; D21H 17/41; D21H 17/44; D21H 17/56; C08B 31/00; C08B 31/006; C08B 31/066; D06M 15/03

USPC ..... 162/9, 141, 147, 158, 164.1, 164.6, 162/168.1–168.3, 175, 181.1–181.9, 182; 428/195.1, 221, 292.1, 297.4, 298.7, 357, 428/364

See application file for complete search history.

(56) References Cited

U.S. PATENT DOCUMENTS

| | | | | |
|---|---|---|---|---|
| 4,566,910 | A * | 1/1986 | Hubbard | C08B 31/16 127/33 |
| 4,643,801 | A * | 2/1987 | Johnson | D21H 17/29 162/164.1 |
| 4,925,530 | A * | 5/1990 | Sinclair | D21H 17/375 162/164.1 |
| 5,158,646 | A | 10/1992 | Nakajima | |
| 5,523,339 | A * | 6/1996 | Solarek | D21H 17/29 524/47 |
| 5,723,023 | A * | 3/1998 | Tsai | D21H 21/10 162/175 |
| 6,303,000 | B1 * | 10/2001 | Floyd | C08B 31/00 106/206.1 |
| 6,365,002 | B1 * | 4/2002 | Bindzus | C08B 31/00 106/206.1 |
| 6,767,430 | B1 * | 7/2004 | Wielema | C08B 31/003 162/175 |
| 6,843,888 | B2 * | 1/2005 | Merrette | D21H 17/29 106/206.1 |
| 6,849,156 | B2 * | 2/2005 | Besemer | A61L 15/28 162/146 |
| 7,074,845 | B2 | 7/2006 | Laleg | |

(Continued)

FOREIGN PATENT DOCUMENTS

| | | | | |
|---|---|---|---|---|
| WO | WO 2010033960 | A1 * | 3/2010 | D21H 11/16 |

OTHER PUBLICATIONS

Vargas, F., et al., "Cellulosic Pulps of Cereal Straws as Raw Material for the Manufacture of Ecological Packaging," BioResources, 7(3): 4161-4170 (2012).

(Continued)

*Primary Examiner* — Jose Fortuna

(74) *Attorney, Agent, or Firm* — Elmore Patent Law Group, P.C.; Mahreen Chaudhry Hoda; Carolyn S. Elmore, Esq.

(57) ABSTRACT

Systems and methods for attaching particulate additives to a population of cellulose fibers dispersed in an aqueous solution are described. The cellulose fibers are treated with an activator that forms complexes with them. The particulate additive is attached to a tether that is capable of interacting with the activator, thereby forming a tether-bearing particulate additive. The tether-bearing particulate additive can be added to the activated suspension of cellulose fibers. The resulting interaction between the tether and the activator forms durable complexes that attach the particulate additive to the cellulose fibers. Using these systems and methods, useful additives like starches can be attached to cellulose fibers, imparting advantageous properties such as increased strength to paper products formed thereby. These systems and methods are particularly useful for papermaking involving virgin pulp fibers, recycled fibers, or any combination thereof.

11 Claims, 4 Drawing Sheets

(56) References Cited

U.S. PATENT DOCUMENTS

| | | | | |
|---|---|---|---|---|
| RE44,519 | E * | 10/2013 | Anderson | D21H 23/06 127/33 |
| 8,894,863 | B2 | 11/2014 | Soane et al. | |
| 8,980,059 | B2 * | 3/2015 | Jogikalmath | D21H 21/18 162/147 |
| 2001/0021453 | A1 | 9/2001 | Hansen et al. | |
| 2002/0088585 | A1 * | 7/2002 | Anderson | D21H 23/06 162/175 |
| 2003/0145966 | A1 * | 8/2003 | Terpstra | D21H 17/28 162/175 |
| 2003/0188738 | A1 * | 10/2003 | Laleg | D21H 17/69 127/32 |
| 2006/0121814 | A1 | 6/2006 | Vinson et al. | |
| 2008/0271865 | A1 | 11/2008 | Soane et al. | |
| 2009/0025895 | A1 * | 1/2009 | Cowman | D21H 23/10 162/162 |
| 2009/0206040 | A1 * | 8/2009 | Berg | C02F 1/54 210/728 |
| 2012/0132383 | A1 | 5/2012 | Laine et al. | |
| 2012/0264603 | A1 | 10/2012 | Soane et al. | |
| 2014/0166222 | A1 * | 6/2014 | Delrue | D21H 11/12 162/146 |
| 2014/0224443 | A1 * | 8/2014 | Jogikalmath | D21H 11/00 162/146 |
| 2015/0101769 | A1 | 4/2015 | Laine et al. | |
| 2015/0101770 | A1 | 4/2015 | Laine et al. | |
| 2015/0144279 | A1 | 5/2015 | Laine et al. | |
| 2015/0176210 | A1 * | 6/2015 | Jogikalmath | D21H 17/28 162/175 |

OTHER PUBLICATIONS

Chandra, M., "Use of Nonwood Plant Fibers for Pulp and Paper Industry in Asia: Potential in China," Degree Paper Submitted to the Faculty of Virginia Polytechnic Institute and State University (1998).

Jogikalmath, G., et al., U.S. Appl. No. 15/000,286, filed Jan. 19, 2016.

* cited by examiner

HIGH STRENGTH PAPER

RELATED APPLICATIONS

This application is a divisional of U.S. application Ser. No. 13/331,861, filed on Dec. 20, 2011, now U.S. Pat. No. 8,980,059, which is a continuation of International Application No. PCT/US10/45162, which designated the United States and was filed on Aug. 11, 2010, published in English, which claims the benefit of U.S. Provisional Application No. 61/233,448, filed Aug. 12, 2009. The entire teachings of the above-referenced applications are incorporated herein by reference.

FIELD OF THE APPLICATION

This application relates generally to making paper products.

BACKGROUND

High strength is desirable in many paper and paperboard applications. One way to achieve this is by manufacturing dense, high-caliper sheets or boards. This requires the use of large amounts of expensive pulp, and produces a heavy product. Another method of creating high strength in paper products is to add starch as sizing.

In one approach, the sizing process uses cooked starch solutions to impart stiffness or strength to the paper. In the sizing process, the wet web is first dried to a pre-set moisture content and/or is re-wet to achieve uniform moisture content throughout; then the material is fed into a size press where a high loading of gelatinized starch is applied to the paper surface; then the material is dried again. This process yields a strong paper, but involves a number of downstream processes that can be inefficient. Inefficiencies result from the number of steps involved in preparing the substrate, cooking the starch and applying it to form the finished product. A considerable amount of energy is required for these steps, which adds to the costs of the process.

In some instances, gelatinized starch can be added to the wet end of the papermaking process, but its retention on the pulp fibers is often poor. Moreover, the contamination of the hitewater with gelatinized starch leads to increased biological oxygen demand of the effluent, so that the process is environmentally unfavorable.

Ungelatinized starch granules can also be added to the wet end of papermaking, but they are also poorly retained. Such starch granules can gelatinize during the drying process, imparting strength to the paper web once it is dry. Adding starch granules in this manner requires lower amounts of energy to dry the paper web, while also eliminating or reducing the use of a size press. As an alternative, ungelatinized starch granules can be incorporated as fillers. In their native state, ungelatinized starch granules do not absorb water like the gelatinized starches, so they can be applied to paper webs that have not been pre-dried. To apply ungelatinized starch, these granules can be sprayed on the moving moist web, and gelatinization can be effected in the dryer. This yields an improvement in dry strength and stiffness of the paper. However, the spraying process does not disperse starch uniformly throughout the thickness of the paper, leading to anisotropic properties.

There remains a need in the art, therefore, for systems and methods for incorporating and retaining ungelatinized starch fillers in the wet end so that high amounts of these fillers are dispersed uniformly in the paper. These fillers should, desirably, be incorporated so that they are stably anchored to the pulp fibers, allowing them to expand or gelatinize during paper manufacturing without being dislodged. In this manner, the fillers can occupy the interstitial spaces between cellulose fibers more completely, improving the rigidity of the paper product. Furthermore, it is known that high filler content has a detrimental effect on the strength of the wet web before it is dried because the fillers act as spacers and interfere with fiber-fiber bonding. An efficient retention system that attaches the fillers to fibers durably in the wet web can advantageously enhance wet web strength during processing by allowing fiber-fiber bonding to proceed unimpeded.

SUMMARY

Figure 1:
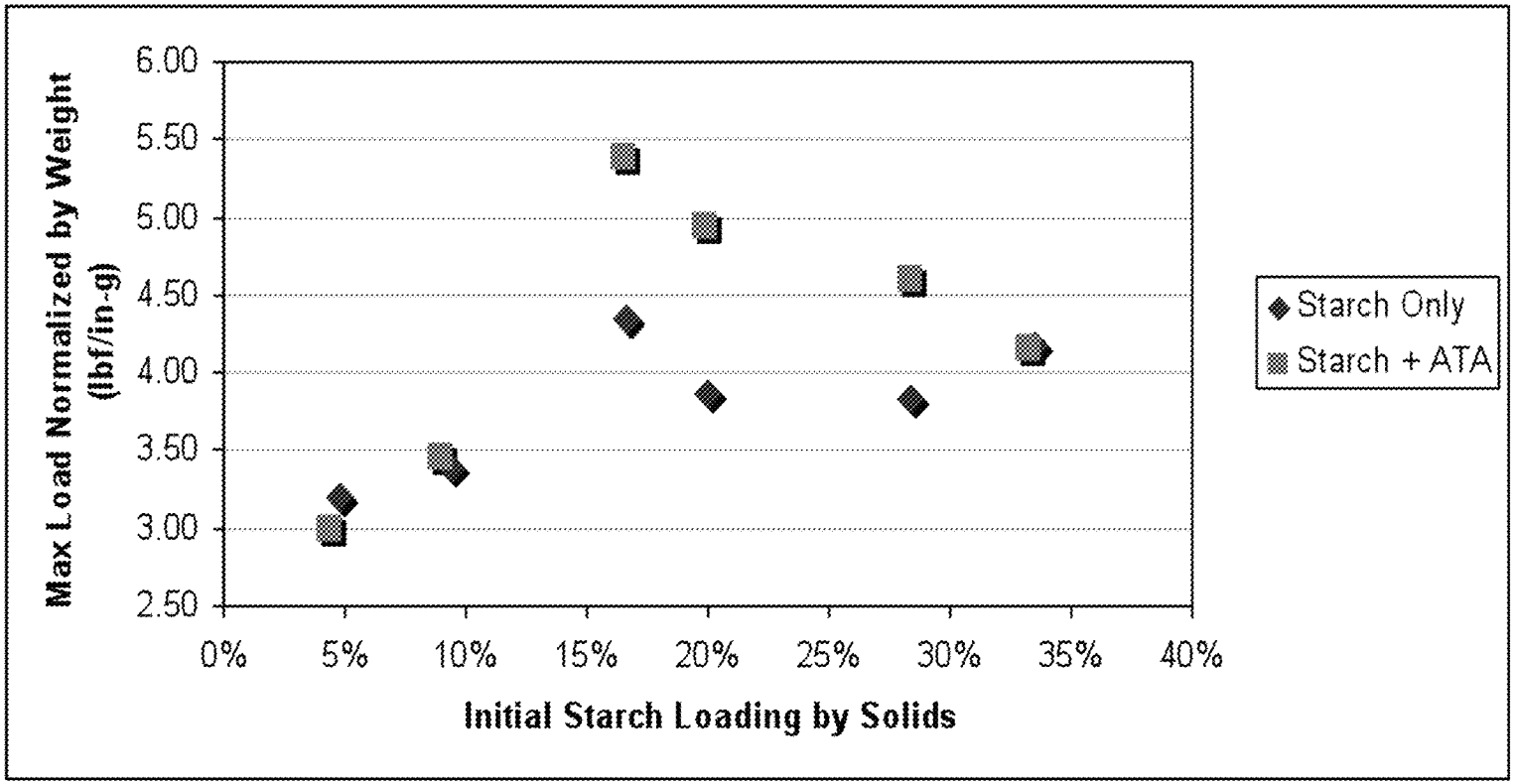
FIG. 1 shows a graph comparing strength with starch loading.

Disclosed herein, in embodiments, are systems for papermaking, comprising a population of cellulose fibers dispersed in an aqueous solution and complexed with an activator, and a tether-bearing particulate additive, wherein the addition of the tether-bearing particulate additive attaches the additive to the population of cellulose fibers by the interaction of the activator and the tether. In embodiments, the particulate additive can be an organic additive. In embodiments, the organic additive can comprise starch, and the starch can be a cationic starch or a hydrophobic starch. In other embodiments, the particulate additive can be an inorganic additive.

Further disclosed herein are methods for manufacturing a paper product, comprising activating a population of cellulose fibers in a liquid medium with an activator, preparing a tether-bearing particulate additive, wherein the tether-bearing particulate additive comprises a tether capable of interacting with the activator; and adding the tether-bearing particulate additive to the activated population of cellulose fibers, thereby attaching the additive to the fibers by the interaction of the activator and the tether. In embodiments, methods are disclosed herein for increasing the strength of a paper product formed from a pulp slurry comprising cellulose fibers, comprising adding an activator polymer to the pulp slurry, forming complexes between the activator polymer and cellulose fibers in the pulp slurry, preparing tether-bearing starch granules, wherein the tether-bearing starch granules comprise a tether polymer capable of interacting with the activator polymer, and adding the tether-bearing starch granules to the pulp slurry, whereby the starch granules are attached to the cellulose fibers by the interaction of the activator polymer and the tether polymer, thereby increasing the strength of the paper product formed from the pulp slurry. Further disclosed herein are paper products manufactured in accordance with these methods. In some embodiments, the invention is a paper product comprising starch granules, wherein said starch granules are attached to cellulose fibers of said paper product by an interaction between an activator polymer and a tether polymer, wherein the activator polymer is attached to the cellulose fibers and the tether polymer is attached to the starch granules.

DETAILED DESCRIPTION

Disclosed herein are systems and methods for enhancing the attachment of a particulate additive to a fibrous matrix, so that the particles are efficiently and durably attached to the coarser fibrous matrix. Also disclosed herein are processes for manufacturing a paper product by forming a complex between a particulate additive (such as starch) and the fibers. The invention also encompasses paper made by the processes or method described herein. The systems and methods disclosed herein involve three components: activating the fibers as they are dispersed in a solution, attaching a tethering agent to the particulate additive, and adding the tether-bearing particulate additive to the dispersion containing the activated fibers, so that the additive is attached to the fibers by the interaction of the activating agent and the tethering agent. In embodiments, these systems and methods can be used to treat fibers used in papermaking with a cationic polymer of a specific molecular weight and composition as an activator, to treat starch granules with an anionic polymer as a tethering agent, and to combine these separately-treated populations so that the starch granules are attached to the pulp fibers.

1. Activation

As used herein, the term "activation" refers to the interaction of an activating material, such as a polymer, with suspended particles or fibers in a liquid medium, such as an aqueous solution. An "Activator polymer" can carry out this activation. In embodiments, high molecular weight polymers can be introduced into the particulate or fibrous dispersion as Activator polymers, so that these polymers interact, or complex, with the dispersed particles or fibers. The polymer-fiber complexes interact with other similar complexes, or with other fibers, and form agglomerates.

This "activation" step can function as a pretreatment to prepare the surface of the suspended material (e.g., fibers) for further interactions in the subsequent phases of the disclosed system and methods. For example, the activation step can prepare the surface of the suspended materials to interact with other polymers that have been rationally designed to interact therewith in a subsequent "tethering" step, as described below. Not to be bound by theory, it is believed that when the suspended materials (e.g., fibers) are coated by an activating material such as a polymer, these coated materials can adopt some of the surface properties of the polymer or other coating. This altered surface character in itself can be advantageous for retention, attachment and/or dewatering.

In another embodiment, activation can be accomplished by chemical modification of the suspended material. For example, oxidants or bases/alkalis can increase the negative surface energy of fibers or particles, and acids can decrease the negative surface energy or even induce a positive surface energy on suspended material. In another embodiment, electrochemical oxidation or reduction processes can be used to affect the surface charge on the suspended materials. These chemical modifications can produce activated particulates that have a higher affinity for tethered anchor particles as described below.

Suspended materials suitable for modification, or activation, can include organic or inorganic particles, or mixtures thereof. Inorganic particles can include one or more materials such as calcium carbonate, dolomite, calcium sulfate, kaolin, talc, titanium dioxide, sand, diatomaceous earth, aluminum hydroxide, silica, other metal oxides and the like. Organic particles can include one or more materials such as starch, modified starch, polymeric spheres (both solid and hollow), carbon based nanoparticles such as carbon nanotubes and the like. Particle sizes can range from a few nanometers to few hundred microns. In certain embodiments, macroscopic particles in the millimeter range may be suitable.

In embodiments, suspended materials may comprise materials such as lignocellulosic material, cellulosic material, minerals, vitreous material, cementitious material, carbonaceous material, plastics, elastomeric materials, and the like. In embodiments, cellulosic and lignocellulosic materials may include wood materials such as wood flakes, wood fibers, wood waste material, wood powder, lignins, wood pulp, or fibers from woody plants.

The "activation" step may be performed using flocculants or other polymeric substances. Preferably, the polymers or flocculants can be charged, including anionic or cationic polymers.

In embodiments, anionic polymers can be used, including, for example, olefinic polymers, such as polymers made from polyacrylate, polymethacrylate, partially hydrolyzed polyacrylamide, and salts, esters and copolymers thereof, such as (sodium acrylate/acrylamide) copolymers, sulfonated polymers, such as sulfonated polystyrene, and salts, esters and copolymers thereof. Suitable polycations include: polyvinylamines, polyallylamines, polydiallyldimethylammoniums (e.g., the chloride salt), branched or linear polyethyleneimine, crosslinked amines (including epichlorohydrin/dimethylamine, and epichlorohydrin/alkylenediamines), quaternary ammonium substituted polymers, such as (acrylamide/dimethylaminoethylacrylate methyl chloride quat) copolymers and trimethylammoniummethylene-substituted polystyrene, and the like. Nonionic polymers suitable for hydrogen bonding interactions can include polyethylene oxide, polypropylene oxide, polyhydroxyethylacrylate, polyhydroxyethylmethacrylate, and the like. In embodiments, an activator such as polyethylene oxide can be used as an activator with a cationic tethering material in accordance with the description of tethering materials below. In embodiments, activator polymers with hydrophobic modifications can be used. Flocculants such as those sold under the trademark MAGNAFLOC® by Ciba Specialty Chemicals can be used.

In embodiments, activators such as polymers or copolymers containing carboxylate, sulfonate, phosphonate, or hydroxamate groups can be used. These groups can be incorporated in the polymer as manufactured, alternatively they can be produced by neutralization of the corresponding acid groups, or generated by hydrolysis of a precursor such as an ester, amide, anhydride, or nitrile group. The neutralization or hydrolysis step could be done on site prior to the point of use, or it could occur in situ in the process stream.

The activated suspended material (e.g., fiber) can also be an amine functionalized or modified. As used herein, the term "modified material" can include any material that has been modified by the attachment of one or more amine functional groups as described herein. The functional group on the surface of the suspended material can be from modification using a multifunctional coupling agent or a polymer. The multifunctional coupling agent can be an amino silane coupling agent as an example. These molecules can bond to a material's surface and then present their amine group for interaction with the particulate matter. In the case of a polymer, the polymer on the surface of a suspended fiber or particle can be covalently bound to the surface or interact with the surface of the particle and/or fiber using any number of other forces such as electrostatic, hydrophobic, or hydrogen bonding interactions. In the case that the polymer is covalently bound to the surface, a multifunctional coupling agent can be used such as a silane coupling agent. Suitable coupling agents include isocyano silanes and epoxy silanes as examples. A polyamine can then react with an isocyano silane or epoxy silane for example. Polyamines include polyallyl amine, polyvinyl amine, chitosan, and polyethylenimine.

In embodiments, polyamines (polymers containing primary, secondary, tertiary, and/or quaternary amines) can also self-assemble onto the surface of the suspended particles or fibers to functionalize them without the need of a coupling agent. For example, polyamines can self-assemble onto the surface of the particles or fibers through electrostatic interactions. They can also be precipitated onto the surface in the case of chitosan for example. Since chitosan is soluble in acidic aqueous conditions, it can be precipitated onto the surface of suspended material by adding a chitosan solution to the suspended material at a low pH and then raising the solution pH.

In embodiments, the amines or a majority of amines are charged. Some polyamines, such as quarternary amines are fully charged regardless of the pH. Other amines can be charged or uncharged depending on the environment. The polyamines can be charged after addition onto the suspended particles or fibers by treating them with an acid solution to protonate the amines. In embodiments, the acid solution can be non-aqueous to prevent the polyamine from going back into solution in the case where it is not covalently attached to the particle or fiber.

The polymers or particles can complex via forming one or more ionic bonds, covalent bonds, hydrogen bonding and combinations thereof, for example. Ionic complexing is preferred.

To obtain activated suspended materials, the activator could be introduced into a liquid medium through several different means. For example, a large mixing tank could be used to mix an activating material with fine particulate materials. Activated particles or fibers are produced that can be treated with one or more subsequent steps of attachment to tether-bearing anchor particles.

2. Tethering

As used herein, the term "tethering" refers to an interaction between an activated suspended particle or fiber and an anchor particle (as described below). The anchor particle, for example, a particulate additive, can be treated or coated with a tethering material. The tethering material, such as a polymer, forms a complex or coating on the surface of the anchor particles such that the tethered anchor particles have an affinity for the activated suspended material. In embodiments, the selection of tether and activator materials is intended to make the two solids streams complementary so that the activated particles or fibers in the suspension become tethered, linked or otherwise attached to the anchor particle.

In accordance with these systems and methods, the tethering material acts as a complexing agent to affix the activated particles or fibers to an anchor material. In embodiments, a tethering material can be any type of material that interacts strongly with the activating material and that is connectable to an anchor particle.

In embodiments, an anchor particle may comprise materials such as lignocellulosic material, cellulosic material, minerals, vitreous material, cementitious material, carbonaceous material, plastics, elastomeric materials, and the like. In embodiments, cellulosic and lignocellulosic materials may include wood materials such as wood flakes, wood fibers, wood waste material, wood powder, lignins, or fibers from woody plants.

Examples of inorganic particles useful as anchor particles include clays such as attapulgite and bentonite. In embodiments, the inorganic compounds can be vitreous materials, such as ceramic particles, glass, fly ash, PCC, GCC, chalk, TiO2, silica, bentonite, kaolin, talc, and the like. The anchor particles may be solid or may be partially or completely hollow. For example, glass or ceramic microspheres may be used as particles. Vitreous materials such as glass or ceramic may also be formed as fibers to be used as particles. Cementitious materials may include gypsum, Portland cement, blast furnace cement, alumina cement, silica cement, and the like. Carbonaceous materials may include carbon black, graphite, carbon fibers, carbon microparticles, and carbon nanoparticles, for example carbon nanotubes.

In embodiments, plastic materials may be used as anchor particles. Both thermoset and thermoplastic resins may be used to form plastic particles. Plastic particles may be shaped as solid bodies, hollow bodies or fibers, or any other suitable shape. Plastic particles can be formed from a variety of polymers. A polymer useful as a plastic particle may be a homopolymer or a copolymer. Copolymers can include block copolymers, graft copolymers, and interpolymers. In embodiments, suitable plastics may include, for example, addition polymers (e.g., polymers of ethylenically unsaturated monomers), polyesters, polyurethanes, aramid resins, acetal resins, formaldehyde resins, and the like. Addition polymers can include, for example, polyolefins, polystyrene, and vinyl polymers. Polyolefins can include, in embodiments, polymers prepared from $C_2$-$C_{10}$ olefin monomers, e.g., ethylene, propylene, butylene, dicyclopentadiene, and the like. In embodiments, poly(vinyl chloride) polymers, acrylonitrile polymers, and the like can be used. In embodiments, useful polymers for the formation of particles may be formed by condensation reaction of a polyhydric compound (e.g., an alkylene glycol, a polyether alcohol, or the like) with one or more polycarboxylic acids. Polyethylene terephthalate is an example of a suitable polyester resin. Polyurethane resins can include, e.g., polyether polyurethanes and polyester polyurethanes. Plastics may also be obtained for these uses from waste plastic, such as post-consumer waste including plastic bags, containers, bottles made of high density polyethylene, polyethylene grocery store bags, and the like.

In embodiments, plastic particles for anchor particles can be formed as expandable polymeric pellets. Such pellets may have any geometry useful for the specific application, whether spherical, cylindrical, ovoid, or irregular. Expandable pellets may be pre-expanded before using them. Pre-expansion can take place by heating the pellets to a temperature above their softening point until they deform and foam to produce a loose composition having a specific density and bulk. After pre-expansion, the particles may be molded into a particular shape and size. For example, they may be heated with steam to cause them to fuse together into a lightweight cellular material with a size and shape conforming to the mold cavity. Expanded pellets may be 2-4 times larger than unexpanded pellets. As examples, expandable polymeric pellets may be formed from polystyrenes and polyolefins. Expandable pellets are available in a variety of unexpanded particle sizes. Pellet sizes, measured along the pellet's longest axis, on a weight average basis, can range from about 0.1 to 6 mm.

In embodiments, the expandable pellets may be formed by polymerizing the pellet material in an aqueous suspension in the presence of one or more expanding agents, or by adding the expanding agent to an aqueous suspension of finely subdivided particles of the material. An expanding agent, also called a "blowing agent," is a gas or liquid that does not dissolve the expandable polymer and which boils below the softening point of the polymer. Blowing agents can include lower alkanes and halogenated lower alkanes, e.g., propane, butane, pentane, cyclopentane, hexane, cyclohexane, dichlorodifluoromethane, and trifluorochloromethane, and the like. Depending on the amount of blowing agent used and the technique for expansion, a range of expansion capabilities exist for any specific unexpanded pellet system. The expansion capability relates to how much a pellet can expand when heated to its expansion temperature. In embodiments, elastomeric materials can be used as particles. Particles of natural or synthetic rubber can be used, for example.

In embodiments, various interactions such as electrostatic, hydrogen bonding or hydrophobic behavior can be used to affix an activated complex to a tethering material complexed with an anchor particle.

For use in papermaking, an anchor particle can be selected from any particulate matter that is desirably attached to cellulose fibers in the final paper product. The tether-bearing anchor particle comprising the desirable additive can then interact with the activated cellulose fibers in the wet paper stream. As an example, starch granules can be used as an anchor particle to be attached to the cellulose fibers, as is described in more detail below. In other examples, organic and inorganic particulate matter can be attached to celluose fibers to achieve desired properties. For example, inorganic materials like calcium carbonate, dolomite, calcium sulfate, kaolin, talc, titanium dioxide, sand, diatomaceous earth, aluminum hydroxide, silica, various other metal oxides, and the like, can be used as anchor particles in accordance with these systems and methods. In other embodiments, organic particles such as starch, modified starch, polymeric spheres (both solid and hollow), carbon based nanoparticles such as carbon nanotubes and the like, can be used as anchor particles in accordance with these systems and methods.

In embodiments, polymers such as linear or branched polyethyleneimine can be used as tethering materials. It would be understood that other anionic or cationic polymers could be used as tethering agents, for example polydiallyldimethylammonium chloride poly(DADMAC). In other embodiments, cationic tethering agents such as epichlorohydrin dimethylamine (epi/DMA), styrene maleic anhydride imide (SMAI), polyethylene imide (PEI), polyvinylamine, polyallylamine, amine-aldehyde condensates, poly(dimethylaminoethyl acrylate methyl chloride quaternary) polymers and the like can be used. Advantageously, cationic polymers useful as tethering agents can include quaternary ammonium or phosphonium groups. Advantageously, polymers with quaternary ammonium groups such as poly(DADMAC) or epi/DMA can be used as tethering agents. In other embodiments, polyvalent metal salts (e.g., calcium, magnesium, aluminum, iron salts, and the like) can be used as tethering agents. In other embodiments cationic surfactants such as dimethyldialkyl(C8-C22)ammonium halides, alkyl(C8-C22)trimethylammonium halides, alkyl(C8-C22)dimethylbenzylammonium halides, cetyl pyridinium chloride, fatty amines, protonated or quaternized fatty amines, fatty amides and alkyl phosphonium compounds can be used as tethering agents. In embodiments, polymers having hydrophobic modifications can be used as tethering agents.

The efficacy of a tethering material, however, can depend on the activating material. A high affinity between the tethering material and the activating material can lead to a strong and/or rapid interaction there between. A suitable choice for tether material is one that can remain bound to the anchor surface, but can impart surface properties that are beneficial to a strong complex formation with the activator polymer. For example, a polyanionic activator can be matched with a polycationic tether material or a polycationic activator can be matched with a polyanionic tether material. In one embodiment, a poly(sodium acrylate-co-acrylamide) activator is matched with a chitosan tether material.

In hydrogen bonding terms, a hydrogen bond donor should be used in conjunction with a hydrogen bond acceptor. In embodiments, the tether material can be complementary to the chosen activator, and both materials can possess a strong affinity to their respective deposition surfaces while retaining this surface property.

In other embodiments, cationic-anionic interactions can be arranged between activated suspended materials and tether-bearing anchor particles. The activator may be a cationic or an anionic material, as long as it has an affinity for the suspended material to which it attaches. The complementary tethering material can be selected to have affinity for the specific anchor particles being used in the system. In other embodiments, hydrophobic interactions can be employed in the activation-tethering system.

As would be further appreciated by those of ordinary skill, tether-bearing anchor particles could be designed to complex with a specific type of activated particulate matter. The systems and methods disclosed herein could be used for complexing with organic waste particles, for example. Other activation-tethering-anchoring systems may be envisioned for removal of suspended particulate matter in fluid streams, including gaseous streams.

3. Retention and Incorporation in Papermaking

It is envisioned that the complexes formed from the anchor particles and the activated fibrous matter can form a homogeneous part of a fibrous product like paper and/or other paper products. Paper products include, for example, products and materials made from cellulose pulp, including, but not limited to, papers, containerboard, paperboard, corrugated containers, recycled paper products, and the like. In embodiments, the interactions between the activated suspended fibers and the tether-bearing anchor particles can enhance the mechanical properties of the complex that they form. For example, an activated suspended material can be durably bound to one or more tether-bearing anchor particles, so that the tether-bearing anchor particles do not segregate or move from their position on the fibers. Increased compatibility of the activated fine materials with a denser (anchor) matrix modified with the appropriate tether polymer can lead to further mechanical stability of the resulting composite material.

For papermaking, cationic and anionic polymers for activators and tethering agents (respectively) can be selected from a wide variety of available polymers, as described above. Starch granules or other desirable particles can be selected as anchor particles, where their attachment to pulp fibers would be advantageous. Examples of such desirable particles include, but are not limited to inorganic and organic anchor particles such as have been described above (e.g., for inorganic materials, calcium carbonate, dolomite, calcium sulfate, kaolin, talc, titanium dioxide, sand, diatomaceous earth, aluminum hydroxide, silica, various other metal oxides and the like, and for organic materials, starch, modified starch, polymeric spheres (both solid and hollow), carbon based nanoparticles such as carbon nanotubes and the like). When starch granules are used as anchor particles for attachment to cellulose fibers, they can be used in their native state, or they can be modified with short amine side-groups, with amine polymers, or with hydrophobic side groups (each such starch encompassed by the term "modified starch"). The presence of amines on the surface of the starch granules can help in attaching an anionic tethering polymer.

For activating the cellulose fibers, cationic polymers can be used. The polycation can be linked to the fiber surface using a coupling agent, for example a bifunctional crosslinking agent such as a carbonyldiimidazole or a silane, or the polyamine can self-assemble onto the surface of the cellulose fiber through electrostatic, hydrogen bonding, or hydrophobic interactions. In embodiments, the polyamine can spontaneously self-assemble onto the fiber surface or it can be precipitated onto the surface. For example, in embodiments, chitosan can be precipitated on the surface of the cellulose fibers to activate them. Because chitosan is soluble only in an acidic solution, it can be added to a cellulose fiber dispersion at an acidic pH, and then can be precipitated onto the surface of the cellulose fibers by slowly adding base to the dispersion until chitosan is no longer soluble. In embodiments, a difunctional crosslinking agent can be used to attach the polycation to the fiber, by reacting with both the polycation and the fiber.

In other embodiments, a polycation such as a polyamine can be added directly to the fiber dispersion or slurry. For example, the addition level of the polycation can be between about 0.01% to 5.0% (based on the weight of the fiber), e.g., between 0.1% to 2%. For example, if the cellulose fiber population is treated with a polyamine like polyDADMAC, a separately treated population of tether-bearing starch granules can be mixed in thereafter, resulting in the attachment of the starch granules to the cellulose fibers by the interaction of the activator polymer and the tether polymer. Starch granules can be treated with a variety of anionic polymers, such as anionic polyacrylamide, which then act as tethers.

While individual retention aids such as polyacrylamide are known in the art to help with the retention of starch granules within a cellulose matrix, the drainage of the paper web is severely affected by the use of these agents individually. The use of a complimentary polycation (e.g., polyDADMAC) as an activator, combined with the use of the polyanion as a tether attached to the starch granules in accordance with these systems and methods avoids this problem, reducing the water retention in the paper web and leading to efficient drainage. Furthermore, the use of these systems and methods eliminates the requirement for cooking the starch before using it, thereby eliminating the gelatinizing ("cooking") step, and decreasing energy utilization.

In certain aspects, the systems and methods described herein result in a percent starch retention within the cellulose matrix of a paper product of at least about 60%, at least about 70%, at least about 80%, at least about 85%, at least about 90% or at least about 90%. In certain aspects, the systems and methods result in a starch retention of at least about 85%. Percent starch retention is the amount of starch retained within the cellulose matrix as a percentage of the total amount of starch added to the pulp slurry. An exemplary method of determining starch retention is described in more detail in the Examples.

Starch that is to be treated in accordance with these systems and methods can be further derivatized or coated with moieties that impart desirable properties, e.g., hydrophobicity, oleophobicity or both. Starches thus modified may be also termed "modified starches." Preferred oil resistant coating formulations are aqueous solutions of cellulose derivatives such as methylcellulose, ethyl cellulose, propyl cellulose, hydroxypropyl methyl cellulose, hydroxyethyl methyl cellulose, ethylhydroxypropyl cellulose, and ethylhydroxyethyl cellulose, cellulose acetate butyrate, which may further comprise polyvinyl alcohol and/or its derivatives. Another group of preferred oil resistant coating compositions are latex emulsions such as the emulsions of polystyrene, styrene-acrylonitrile copolymer, carboxylated styrene-butadiene copolymer, ethylene-vinyl chloride copolymer, styrene-acrylic copolymer, polyvinyl acetate, ethylene-vinyl acetate copolymer, and vinyl acetate-acrylic copolymer. The starch granule thus coated with grease resistant formulations could be attached to the activated pulp fibers via tethering, such that the surface segregation of the starch granule will modify the surface of the paper product.

In embodiments, the presence of hydrophobic starch also improves the hydrophobicity of the resulting paper without needing an internal sizing such as alkyl succinic anhydride (ASA), alkyl ketene dimer (AKD) or Rosin. The gelatinized hydrophobic starch sizes the entire thickness of the paper. This property is useful in reducing the coating requirements in making coated sheets. The coating applied using a roller or a metering bar or any such methods, would remain on the surface of the paper and not impregnate the bulk of the paper thus needing less coating to achieve the same amount of gloss and surface finish.

In other embodiments, the addition of a coating agent to the starch can improve its mechanical properties such as bending stiffness or tensile strength, or could improve its optical properties (e.g., TiO2 nanoparticles bound to starch).

As will be understood by the skilled artisan, after adding the tether bearing particulate additive to the population of cellulose fibers, the slurry can be subjected to additional steps in order to make a paper product. For example, the slurry can be mixed, drained of water, added to a handsheet maker, dried and/or pressed, or any combination thereof. An exemplary method of making a handsheet is described in the Examples below.

EXAMPLES

Materials

Market softwood and hardwood pulp

Recycled and deinked pulp from magazine and newsprint

Poly(diallyldimethylammonium chloride), Hi Molecular Weight, 20 wt % in water (polyDADMAC), Sigma-Aldrich, St. Louis, Mo.

MagnaFloc LT30 (PAM) Ciba Specialty Chemicals Corporation, Suffolk, Va.

STA-LOK 356 Starch, Tate & Lyle, Decatur, Ill. (cationic starch granules)

ChitoClear Chitosan CG800, Primex, Siglufjordur, Iceland

Lupamin 9095, BASF Corporation, Florham Park, N.J.

R465 Cationic Starch, Grain Processing Corporation, Muscatine, Iowa

FilmKote hydrophobic starches, National Starch LLC, Bridgewater N.J.

Example 1

Control Virgin Pulp

A 0.5% slurry was prepared by blending 3.5% by weight softwood and hardwood pulp mixture (in the ratio of 20:80) in water.

Example 2

Control Recycled Pulp

A 0.5% slurry was prepared by blending 3.1% recycled deinked pulp in water.

Example 3

Handsheet Preparation

Handsheets were prepared using a Mark V Dynamic Paper Chemistry Jar and Hand-Sheet Mold from Paper Chemistry Laboratory, Inc. (Larchmont, N.Y.). Handsheets were prepared without addition of polymers as controls, using the control pulps as described in Example 1 and 2. Handsheets were prepared with the addition of polymers as experimental samples, as described below. For preparing each experimental handsheet, the appropriate volume of 0.5% pulp slurry prepared in accordance with Examples 1 or 2 (as applicable) was activated with up to 2% of the selected polymer(s) (based on dry weight), as described below in more detail. Polymer additions were performed at 5 minute intervals. This polymer-containing slurry was diluted with up to 2 L of water and added to the handsheet maker, where it was mixed at a rate of 1100 RPM for 5 seconds, 700 RPM for 5 seconds, and 400 RPM for 5 seconds. The water was then drained off. The subsequent sheet was then transferred off of the wire, pressed and dried.

Example 4

Tensile Test

Tensile tests were conducted on control and experimental samples using an Instron 3343. Samples of handsheets for tensile testing were initially cut into 1 in wide strips with a paper cutter, then attached within the Instron 3343. The gauge length region was set at 4 in and the crosshead speed was 1 in/minute. Thickness was measured to provide stress data as was the weight to be able to normalize the data by weight of samples. The strips were tested to failure with an appropriate load cell. At least three strips from each control or experimental handsheet sample were tested and the values were averaged together.

Example 5

Preparation of Tethered Starches

Sta Lok 356 or Filmkote starches were dispersed in water such that the solids content was about 20 to 25% to get a slurry of cationic and hydrophobic starches respectively. 1% by weight of anionic polyacrylamide magnafloc LT30 was used as the tethering agent.

Example 6

Process for Preparing Handsheets from Activated Pulp and Tethered Starch 800 ml of a 0.5% pulp slurry prepared in accordance with Example 1 or 2 (as applicable) was initially provided. The pulp slurry was activated with 1% by fiber weight poly-DADMAC. Separately, tethered cationic (or hydrophobic) starch granules were prepared as a slurry in accordance with Example 5. Each slurry was mixed for 5 minutes and then combined and mixed for another 5 minutes using an overhead stirrer. Handsheets were then produced by the method in Example 3. The final paper weight was approximately 4 g for these handsheets.

Example 7

Starch Retention Measurement

Starch retention was determined by first analyzing the effluent created after making the handsheets in Example 6. A piece of VWR Grade 413 filter paper with 5 μm particle retention was initially dried in an oven at 110° C. to remove any moisture and then weighed. The effluent from the handsheet preparation carried out in Example 5 was then filtered through the paper using vacuum filtration. The filter paper was dried again at 110° C. to remove any moisture, and was weighed to determine the lost solids from the handsheet. These solids included the fines from the papermaking process and starch granules. To normalize for only the starch contribution to the effluent, a control experiment was run using the effluent from the preparation of a control pulp using the activator polymer but no starch addition. The filtered solid content in the control effluent was subtracted from the filtered solid content in the starch-bearing effluent, to yield the amount of starch therein. This amount was used to determine the starch retention of the pulp in Example 6.

Example 8

Effect on Starch Retention of Polymeric Retention Aids Added to Cellulose Pulp—(No Starch Tethering)

Experiments were carried out to evaluate the starch retention effects of various polymers that can be used to functionalize cellulose fibers. A pulp slurry prepared in accordance with Example 1 was treated with the various polymers listed in Table 1, at the loading levels listed in the Table. The Table lists the effects of the various cellulose fiber polymeric treatments on starch retention, where starch retention was measured in accordance with Example 7. The anionic polyacrylamide (LT 30) resulted in good starch retention, but was observed during the experiment to adversely affect the drainage of water.

TABLE 1

| Sample | % Starch Retention |
|---|---|
| Pulp | |
| Starch | 51% |
| Chitosan 0.1% | 47% |
| Chitosan 0.5% | 37% |
| Chitosan 1.0% | 42% |
| LT 30 0.1% | 75% |
| LT 30 0.5% | 93% |

TABLE 1-continued

| Sample | % Starch Retention |
|---|---|
| LT 30 1.0% | 89% |
| DADMAC 0.1% | 33% |
| DADMAC 0.5% | 31% |
| DADMAC 1.0% | 29% |
| Polyvinylamine 1.0% | 42% |

Example 9

The Effect of Starch Loading on Strength

Samples were prepared as in Example 6, where the amount of tether-bearing starch (Sta Lok 356) ranged from 0.18 g to 2.0 g, i.e., initial loadings of 4% to 33% of the solids weight. The tether-bearing starch was prepared in accordance with Example 5. Samples were made both with activator and tether and without either activator or tether. For samples made with activator, tether and the anchor (ATA), the tether used on the starch was 1% MagnaFloc LT30 by solids and the activator on the pulp was 1% polyDADMAC by solids. Starch retention was measured as set forth in Example 7, and the max load for each sample was measured using an Instron as in Example 4. Data were normalized by the mass to show load contribution per overall solids weight. Graph 1 (FIG. 1) shows the strength improvement with starch loading with and without the ATA process chemistry. For all samples functionalized with the ATA chemistry described in Example 6, the starch granule retention was >98%. Without being bound by theory, it is understood that the inclusion of untethered starch in the unactivated paper matrix is limited by the amount physical entanglements between starch and cellulose, reflected in the plateau in strength measurement with higher loads of starch added without ATA processing. With ATA, a greater amount of starch can be attached effectively to the cellulose, progressively increasing strength as shown in FIG. 1. As the amount of ATA-bound starch increases, it yields a maximum benefit in strength, which then decreases at higher loadings. It is hypothesized that the higher loadings beyond the maximum exceed the capacity of the hydrogen bonding network of the cellulose fibers.

Example 10

The Effect of Starch Loading on Strength and Hydrophobicity

Samples were prepared as in Example 6 with tether-bearing Sta Lok 356 starch. Starch retention was measured as set forth in Example 7, and the tensile strength for each sample was measured using an Instron as in Example 4. As set forth in Table 3, certain of the samples were treated with polyDADMAC as activator in concentrations of 1% by solids, and with MagnaFloc LT30 as the tethering agent attached to the starch in concentrations of 1% by solids all in accordance with Example 6. These samples are designated as ATA Process samples in the table below (Table 3).

TABLE 3

| Fiber Wt (g) | Starch Overall Loading | Starch Amt (g) | ATA Process | Starch in effluent (g) | % Starch Retention | Actual Starch Loading | Tensile Load/Wt |
|---|---|---|---|---|---|---|---|
| 4 | 0% | 0.0000 | No | 0.009 | | 0% | 2.62 |
| 4 | 17% | 0.8007 | No | 0.318 | 60% | 11% | 3.75 |
| 4 | 17% | 0.8066 | Yes | 0.014 | 98% | 17% | 4.52 |
| 4 | 9% | 0.4064 | No | 0.171 | 58% | 6% | 3.63 |
| 4 | 9% | 0.3999 | Yes | 0.003 | 99% | 9% | 4.02 |
| 4 | 5% | 0.2072 | No | 0.074 | 64% | 3% | 3.46 |
| 4 | 5% | 0.2019 | Yes | 0.006 | 97% | 5% | 3.56 |

Figure 2:
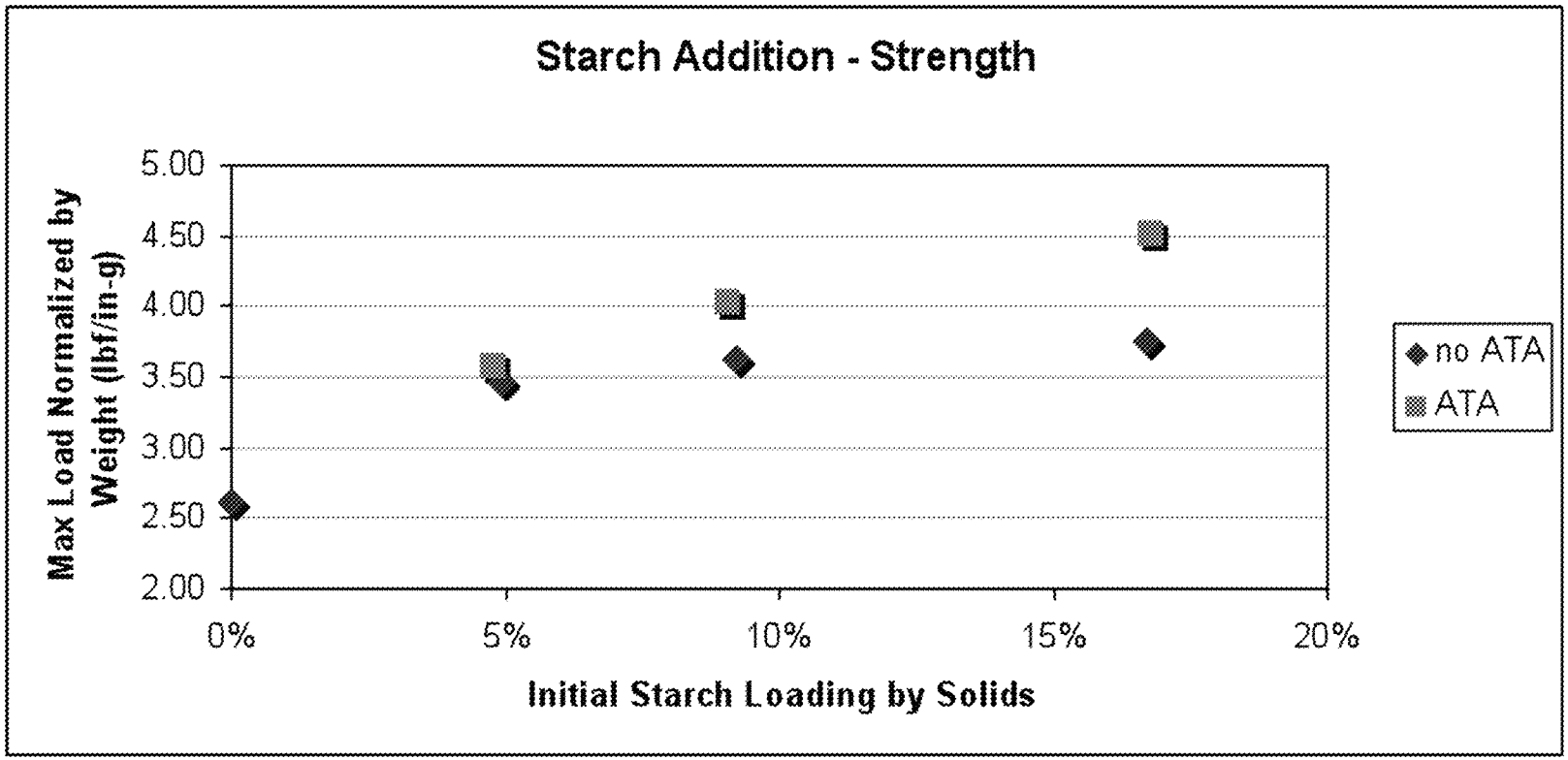
FIG. 2 shows a graph comparing strength with starch retention.

Graph 2 (FIG. 2) illustrates the effect of starch retention on the strength of the paper. Graph 2 compares the difference between strength of the handsheets made with the ATA Process compared to handsheets that have not been treated with any polymer addition.

Example 11

Figure 3:
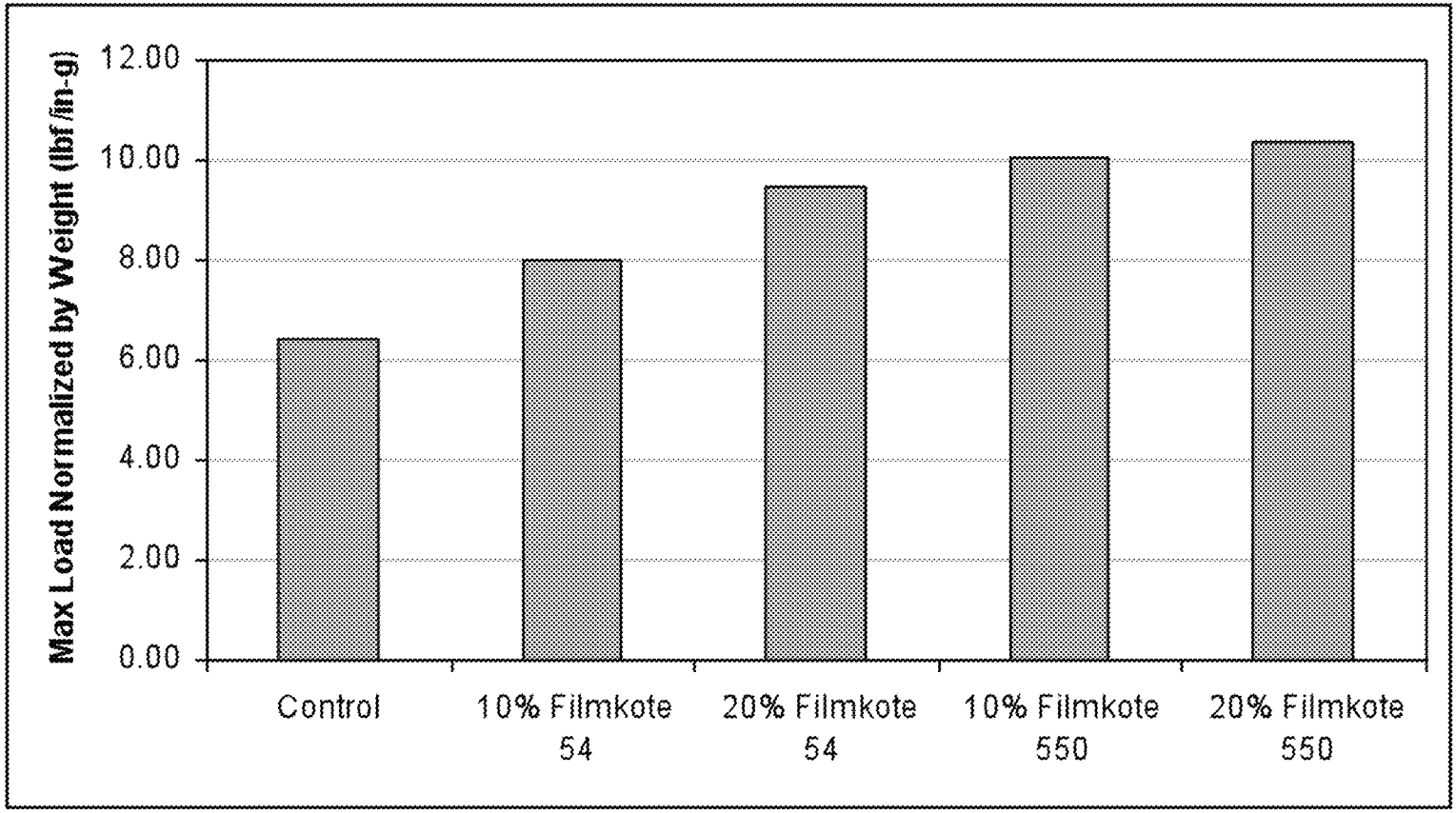
FIG. 3 shows tensile strength of paper samples.

Effect of Hydrophobic Starch Loading on Strength of Paper Made with Recycled Fibers Recycled fibers are relatively weak due to fiber length reduction during fiber recovery and processing. In this example, the ATA process is applied to improve the strength of handsheets made from recycled fibers by incorporating starch within the fibrous web. To produce handsheets of recycled paper using the ATA process, a recycled pulp slurry prepared in accordance with Example 3 was treated in accordance with Example 6, using Filmkote hydrophobic starches as tether-bearing starches. Filmkote starches of varying degrees of hydrophobicity were used, as set forth in Graph 3 (FIG. 3). For example, the starch Filmkote 550 is more hydrophobic than Filmkote 54. The tensile strength of the paper samples was measured as set forth in Example 4. As shown in Graph 3 (FIG. 3), the ATA process as applied to recycled paper improved the strength of the paper samples by amounts from about 25-40%.

Example 12

Figure 4:
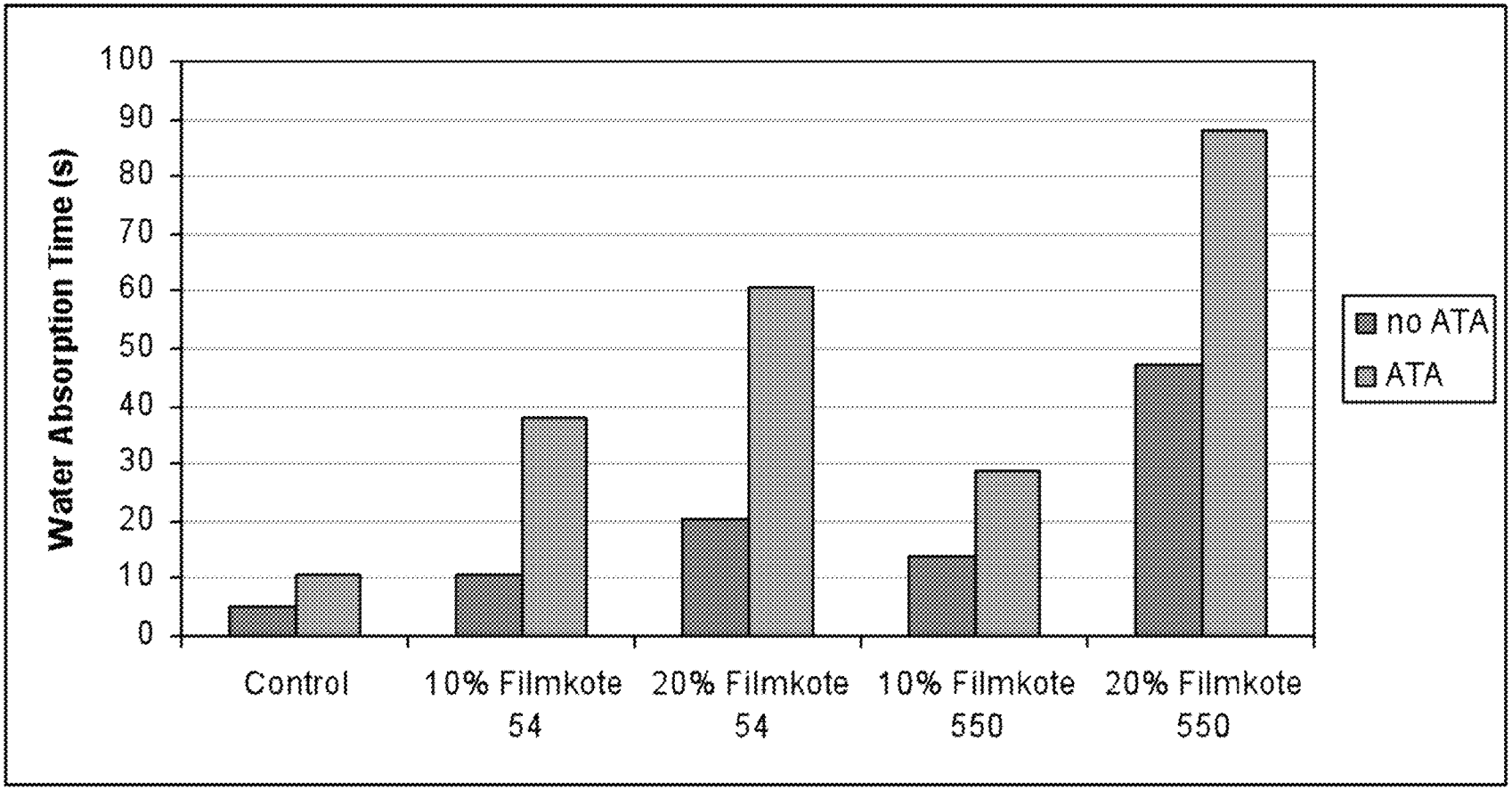
FIG. 4 shows results from hydrophobicity tests on paper samples.

Effect of Hydrophobic Starch Loading on Hydrophobicity of Paper Made with Recycled Fibers Using recycled fiber handsheet samples prepared as in Example 11, hydrophobicity was tested by depositing a 15 microliter water droplet on the surface of the paper and recording the time for the droplet to completely absorbed by the paper. The results of the hydrophobicity tests are shown in Graph 4 (FIG. 4). These results demonstrate that the use of the ATA process to attach hydrophobic starches to recycled pulp fibers improves the water resistance of the paper by nearly 500% compared to control samples having no added no starch.

EQUIVALENTS

While specific embodiments of the subject invention have been discussed, the above specification is illustrative and not restrictive. Many variations of the invention will become apparent to those skilled in the art upon review of this specification. Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the present invention. While this invention has been particularly shown and described with references to preferred embodiments thereof, it will be understood by those skilled in the art that various changes in form and details may be made therein without departing from the scope of the invention encompassed by the appended claims.

What is claimed:

1. A paper product comprising starch granules, wherein said starch granules are attached to cellulose fibers of said paper product by an interaction between an activator polymer and a tether polymer, wherein the cellulose fibers are coated with the activator polymer, and the tether polymer forms a coating on the starch granules, and further wherein the activator polymer is a cationic polymer and the tether polymer is an anionic polymer.

2. The paper product of claim 1, wherein the paper product is selected from the group consisting of papers, containerboard, paperboard, corrugated containers and recycled paper products.

3. The paper product of claim 1, wherein the starch is a modified starch.

4. The paper product of claim 3, wherein the modified starch is a starch derivatized with moieties that impart hydrophobicity, oleophobicity, or both.

5. The paper product of claim 3, wherein the modified starch is starch modified with amine polymers or hydrophobic side groups.

6. The paper product of claim 1, wherein the starch granule comprises a hydrophobic starch.

7. The paper product of claim 1, wherein the starch granules are gelatinized.

8. The paper product of claim 1, wherein the cellulose fibers are recycled fibers.

9. The paper product of claim 1 formed according to a method comprising the following steps:

activating a population of cellulose fibers in a liquid medium with an activator polymer to form an activated population of cellulose fibers;

preparing a tether-bearing starch granule, wherein the tether-bearing particulate starch granule comprises a tether polymer that interacts with the activator polymer; and adding the tether-bearing starch granule to the activated population of cellulose fibers, thereby attaching the starch granules to the cellulose fibers by the interaction of the activator polymer and the tether polymer.

10. The paper product of claim 9, wherein the method comprises preparing a tether-bearing starch granule, wherein the starch granule is ungelatinized.

11. The paper product of claim 10, wherein the starch granule gelatinizes during paper manufacturing.

* * * * *